US009075360B2

(12) United States Patent
Kikkawa

(10) Patent No.: US 9,075,360 B2
(45) Date of Patent: Jul. 7, 2015

(54) IMAGE HEATING APPARATUS

(71) Applicant: CANON KABUSHIKI KAISHA, Tokyo (JP)

(72) Inventor: Naoya Kikkawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/013,440

(22) Filed: Aug. 29, 2013

(65) Prior Publication Data

US 2014/0064805 A1 Mar. 6, 2014

(30) Foreign Application Priority Data

Sep. 6, 2012 (JP) ..... 2012-195678

(51) Int. Cl.
*G03G 15/20* (2006.01)

(52) U.S. Cl.
CPC .... *G03G 15/2053* (2013.01); *G03G 2215/2035* (2013.01)

(58) Field of Classification Search
CPC ..... G03G 15/2082; G03G 15/2053
USPC ..... 399/329, 334, 335
See application file for complete search history.

(56) References Cited

U.S. PATENT DOCUMENTS

| | | | | |
|---|---|---|---|---|
| 6,252,212 | B1 * | 6/2001 | Takagi et al. | 219/619 |
| 8,712,272 | B2 * | 4/2014 | Takeuchi et al. | 399/69 |
| 2004/0101334 | A1 * | 5/2004 | Tatematsu et al. | 399/329 |
| 2006/0245797 | A1 * | 11/2006 | Suzuki | 399/328 |
| 2008/0267676 | A1 * | 10/2008 | Takai et al. | 399/335 |
| 2012/0155934 | A1 | 6/2012 | Takeuchi et al. | |
| 2013/0058673 | A1 | 3/2013 | Kikkawa | |

FOREIGN PATENT DOCUMENTS

JP 2012-128312 A 7/2012

* cited by examiner

*Primary Examiner* — Rodney Bonnette
(74) *Attorney, Agent, or Firm* — Fitzpatrick, Cella, Harper & Scinto

(57) ABSTRACT

An image heating apparatus includes an image heating roller, an excitation coil provided outside of the roller for causing electromagnetic induction heat generation in the roller, a magnetic core, provided opposed to the roller with the excitation coil therebetween, for directing a magnetic flux produced by the excitation coil to the roller, a retracting mechanism for retracting the magnetic core from the excitation coil, coil holder for holding a side of the excitation coil adjacent to the roller, and first and second pressing members for pressing the excitation coil against the holder in each of longitudinally opposite portions that are outside beyond the magnetic core.

13 Claims, 12 Drawing Sheets

(a)

(b)

IMAGE HEATING APPARATUS

FIELD OF THE INVENTION AND RELATED ART

The present invention relates to an image heating apparatus usable with an image forming apparatus such as a copying machine, a printer, a facsimile machine or a complex machine having functions of these machines.

In the image forming apparatus using an electrophotographic type or the like, a toner image is formed by an image forming station and is transferred onto a recording material, which is fed into a fixing device as an image heating apparatus to fix the toner image on the recording material.

Recently, an electromagnetic-induction, heating-type fixing device has been proposed in view of an energy use efficiency.

When such a fixing process is carried out on a small width recording material, in a region (non-passing region) of a fixing member (rotatable heating member) which is not contacted by the recording material, the heat is not transferred to the recording material, and therefore, the temperature of the fixing member excessively rises. Under the circumstances, it has been proposed that a magnetic core disposed in the portion corresponding to the non-passing portion is retracted from an excitation coil (Japanese Laid-open Patent Application 2012-128312).

However, if the magnetic core is retracted as disclosed in Japanese Laid-open Patent Application 2012-128312, the excitation coil may be away from a proper position with the result of an enlarged gap relative to the fixing member. More particularly, the excitation coil may be spaced from a coil holder holding the excitation coil, due to the thermal expansion and heat contraction. Here, if the magnetic core is stationary or fixed, the spacing can be avoided, but if a movable-type magnetic core is employed from the standpoint of suppression of the excessive temperature rise of the non-passing portion, the problem of the spacing results.

When the spacing occurs, the gap between the fixing member and the excitation coil or the gap between the excitation coil and the magnetic core is unstable with the result of non-uniform temperature distribution of the fixing member, and therefore, image defects such as unevenness image glossiness or the like is produced.

Accordingly, it is desired that the magnetic core is movable and the spacing is avoided.

According to an aspect of the present invention, there is provided an image heating apparatus comprising a rotatable heating member configured and positioned to heat a toner image on a sheet, an excitation coil provided outside of the rotatable heating member and configured and positioned to cause electromagnetic induction heat generation in the rotatable heating member, a magnetic core provided opposed to the rotatable heating member with the excitation coil therebetween and configured and positioned to direct a magnetic flux produced by the excitation coil to the rotatable heating member, a retracting mechanism configured to retract the magnetic core from the excitation coil, a coil holder configured and positioned to hold a side of the excitation coil adjacent to the rotatable heating member, and first and second pressing members configured and positioned to press the excitation coil against the holder in each of opposite longitudinally portions which are outside beyond the magnetic core.

Further features of the present invention will become apparent from the following description of exemplary embodiments (with reference to the attached drawings).

These and other objects, features and advantages of the present invention will become more apparent upon a consideration of the following description of the preferred embodiments of the present invention taken in conjunction with the accompanying drawings.

DESCRIPTION OF THE EMBODIMENTS

Figure 1:
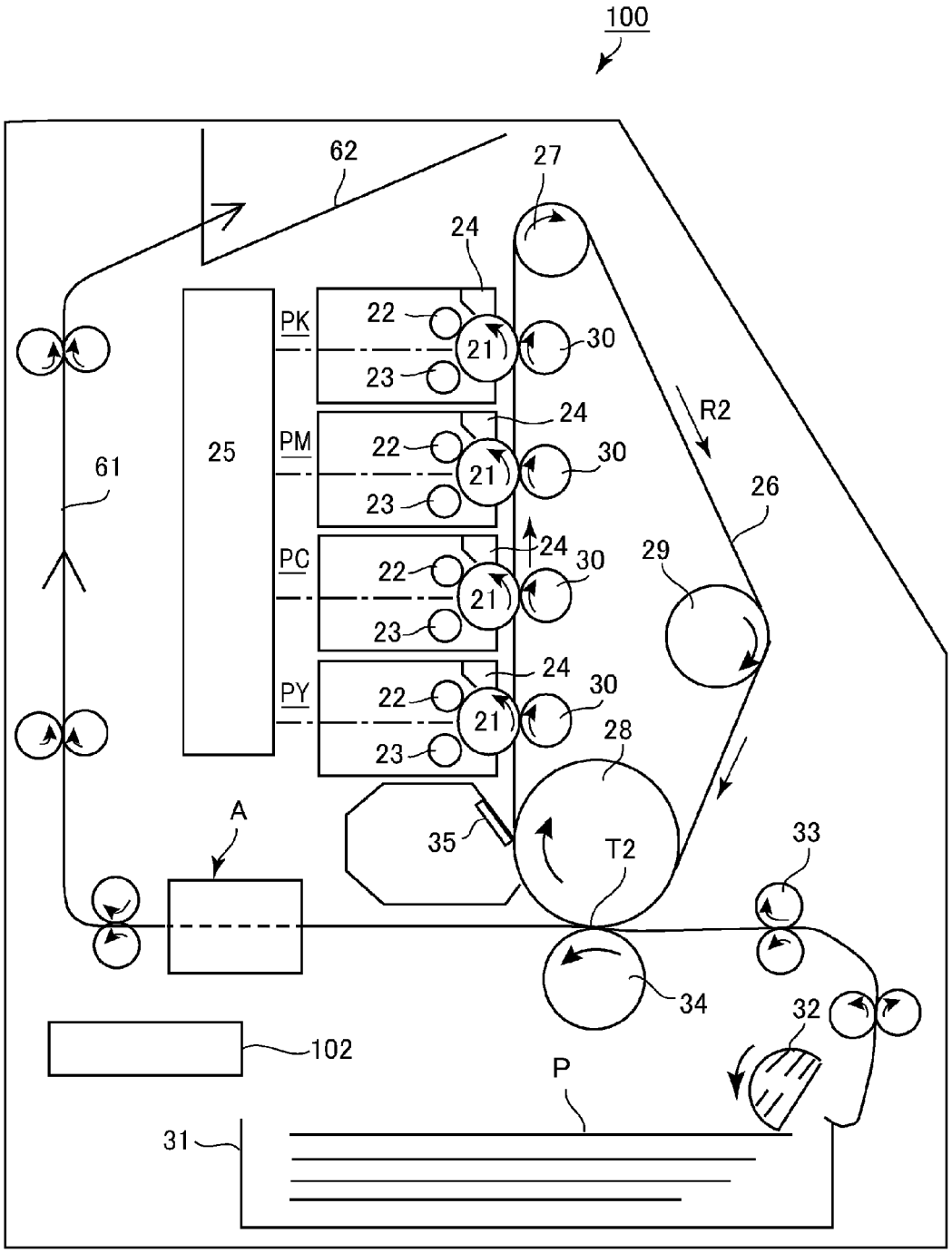
FIG. 1 is a schematic sectional view of an image forming apparatus.

Referring to FIG. 1 to FIG. 15, an embodiment of the image heating apparatus according to the present invention will be described. Referring first to FIG. 1, the structure of the image forming apparatus including the image heating apparatus will be described.

Image Forming Apparatus

An image forming apparatus 100 shown in FIG. 1 is a color image forming apparatus of an electrophotographic type. Designated by PY, PC, PM, PK are image forming stations for forming yellow, cyan, magenta and black toner images, respectively, and they are arranged in the order named. Image forming stations PY, PC, PM, PK each include a photosensitive drum (photosensitive member) 21 as an image bearing member, a charging device 22, a developing device 23 and a cleaning device 24.

The developing device 23 of the image forming station PY contains yellow toner; the developing device 23 of the image forming station PC contains cyan toner; the developing device 23 of the image forming station PM contains magenta toner; and the developing device 23 of the image forming station PK contains black toner.

An exposure device 25 is provided for the image forming stations PY, PC, PM, PK and is capable of forming electrostatic latent images by exposure of the photosensitive drums 21. The exposure device 25 is a laser scanning exposure optical system.

In each of the image forming stations PY, PC, PM, PK, the photosensitive drum 21 is charged uniformly by the charging device 22 and is scanningly exposed by the exposure device 25 in accordance with image data. By this, an electrostatic latent image is formed corresponding to an exposed pattern on the photosensitive drum 21 of each of the image forming stations PY, PC, PM, PK.

The electrostatic latent images are developed into toner images by the respective developing devices 23. More particularly, a yellow toner image is formed on the photosensitive drum 21 of the image forming station PY, and a cyan toner image is formed on the photosensitive drum 21 of the image forming station PC. In addition, a magenta toner image is formed on the photosensitive drum 21 of the image forming station PM, and a black toner image is formed on the photosensitive drum 21 of the image forming station PK.

The color toner images formed on the photosensitive drums 21 of the image forming stations PY, PC, PM, PK are primary-transferred superposingly with a predetermined alignment relationships onto an intermediary transfer belt 26 as an intermediary transfer member which rotates in synchronism with the rotation of the associated photosensitive drum 21 at substantially the same speed. An unfixed full-color toner image is synthetically formed on the intermediary transfer belt 26. In this embodiment, the intermediary transfer belt 26 includes an endless belt which is extended around a driving roller 27, a secondary transfer opposing roller 28 and a tension roller 29 (three rollers) and is driven by the driving roller 27.

A primary transferring means for transferring the toner images from the photosensitive drums 21 of the image forming stations PY, PC, PM, PK onto the intermediary transfer belt 26 is a primary transfer roller 30 in this embodiment. To the primary transfer roller 30, a primary transfer bias of a polarity opposite to that of the toner is applied from a bias voltage source (unshown). By this, the toner images are primary-transferred from the photosensitive drums 21 of the image forming stations PY, PC, PM, PK onto the intermediary transfer belt 26. In each image forming station PY, PC, PM, PK, the toner remaining as residual toner on the photosensitive drum 21 after the primary transfer from the photosensitive drum 21 onto the intermediary transfer belt 26 is removed by the cleaning device 24.

The primary transfer operations are carried out for the yellow, magenta, cyan and black colors in synchronism with the rotation of the intermediary transfer belt 26 to superimpose them on the intermediary transfer belt 26. In a monochromatic mode, the foregoing operations are carried out only for one color.

On the other hand, the recording material (sheet) P is fed out of the recording material cassette 31 one by one by a feeding roller 32. It is fed at predetermined timing by registration rollers 33 to a secondary transfer portion T2 which is a press-contact portion between a secondary transfer roller 34 and the intermediary transfer belt 26 wound on the secondary transfer opposing roller 28.

The synthetic primary transfer image formed on the intermediary transfer belt 26 is secondary-transferred all together onto the recording material P by a bias voltage of the polarity opposite the toner by the bias voltage source (unshown) applied to the secondary transfer roller 34. Secondary-untransferred toner remaining on the intermediary transfer belt 26 after the secondary transfer is removed by an intermediary transfer belt cleaning device 35.

The toner image secondary transferred onto the recording material is melted, mixed and fixed on the recording material by a fixing device A functioning image heating apparatus, and the recording material is delivered to a sheet discharge tray 62 through a sheet discharge path 61 as a full color print.

Fixing Device

Referring to FIG. 2 to FIG. 7, the fixing device A will be described. In following description, the longitudinal direction of a fixing device or a member constituting it is a direction perpendicular to a feeding direction of recording material in a recording material feeding path surface (widthwise direction of the recording material being fed). In addition, the widthwise direction of the fixing device or the member constituting it is the direction parallel with the feeding direction of recording material. With respect to the fixing device, the front side is a side of an entrance for the recording material, and the rear surface is a side opposite thereto (recording material exit side), and left and right are left-hand and right-hand as seen from the front side. The upstream side and the downstream side are based on the feeding direction of the recording material.

Figure 2:
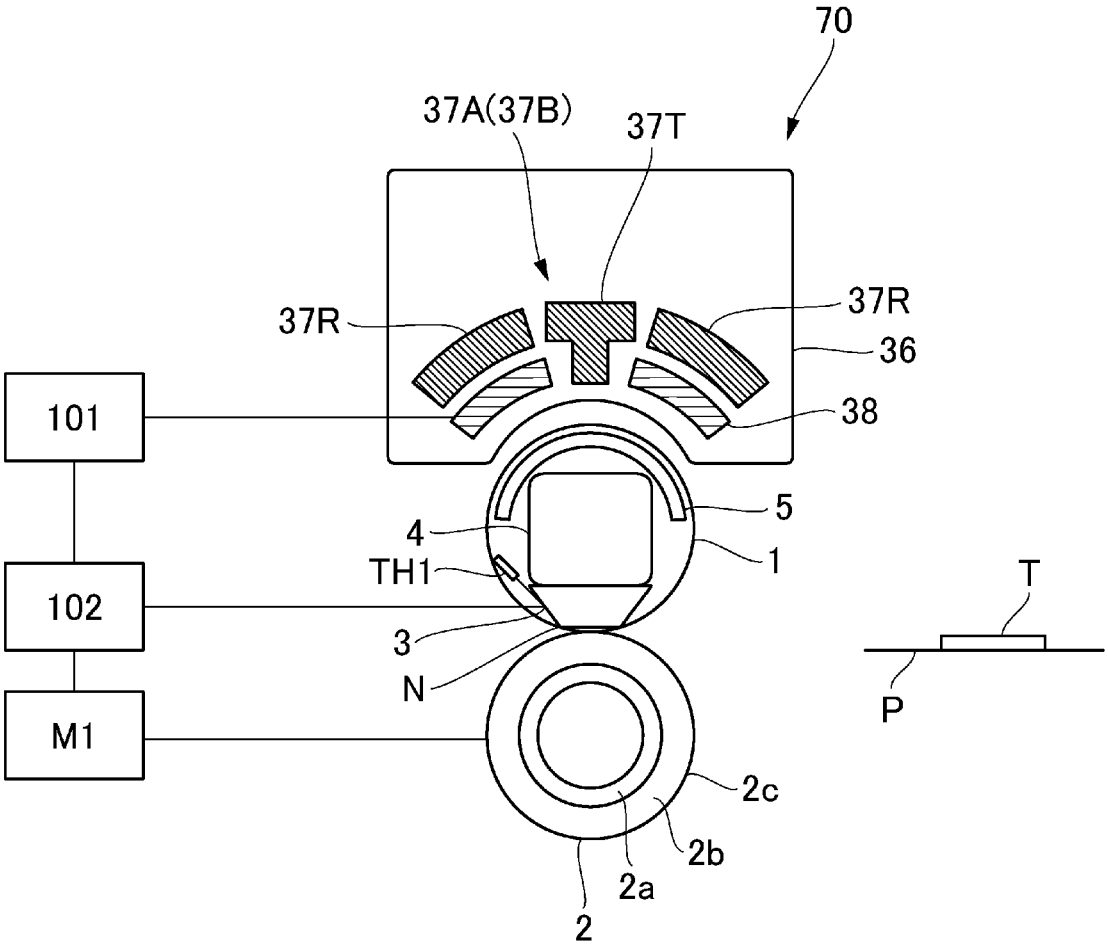
FIG. 2 is a schematic cross-sectional view of a fixing device.

As shown in FIG. 2, the fixing device A comprises a fixing belt 1 as a heating member (rotatable heating member), a pressing roller 2 as a nip forming member, an induction heating device 70 as a magnetic flux generating means. The fixing belt 1 is an endless heating belt including a metal layer. The pressing roller 2 is pressing rotatable member contacting to an outer periphery of the fixing belt 1.

Figure 3:
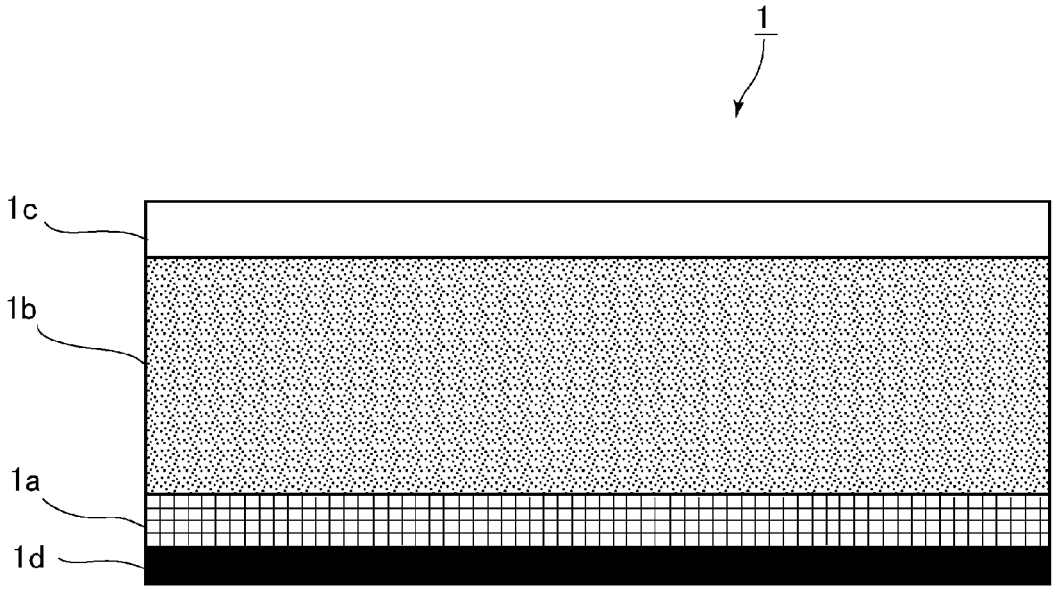
FIG. 3 is a layer structure view of a fixing belt.

As shown in FIG. 3, the fixing belt 1 includes a nickel base layer (metal layer, heat generation layer) 1*a* manufactured by an electrocasting method, the base layer having an inner diameter of approx. 20-40 mm, for example. The base layer 1*a* has a thickness of 40 μm. On the outer periphery of the base layer 1*a*, a heat resistive silicone rubber layer is provided as the elastic layer 1*b*. The thickness of the silicone rubber layer is preferably 100-1000 μm. In this embodiment, the thickness of the silicone rubber layer is 1000 μm from the standpoint of providing a preferable fixed color image while reducing a thermal capacity of the fixing belt 1 to shorten the warming-up time. The silicone rubber has a hardness (JIS-A20 degrees) and a thermal conductivity of 0.8 W/mK. Furthermore, the outer periphery of the elastic layer 1*b* is coated with a 30 μm thickness of a fluorinated resin material layer (PFA or PTFE, for example) as a surface parting layer 1*c*.

The inner surface of base layer 1*a* may be provided with a resin material layer (sliding layer) 1*d* of fluorinated resin material or polyimide having a thickness of 10-50 μm to decrease a sliding friction relative to a temperature sensor TH1 (FIG. 2 the which will be described hereinafter. In this embodiment, the layer 1*d* is made of polyimide having the thickness of 20 μm.

The base layer 1*a* of the fixing belt 1 may be made of ferro-alloy, copper, silver or the like. Or, it may be a base resin layer on which a metal layer is laminated. The thickness of the base layer 1*a* is selected in a range of 5-200 μm in accordance with a frequency of a high frequency current through an excitation coil, a magnetic permeability and an electrical conductivity of the metal layer, which will be described hereinafter.

As shown in FIG. 2 the pressing roller 2 includes a metal core of a ferro-alloy having an outer diameter of 40 mm, and a silicone rubber layer as an elastic layer 2*b*. The surface thereof is coated with a parting layer 2*c* of fluorinated resin material layer (PFA or PTFE, for example) having a thickness of 30 μm. A hardness of the pressing roller 2 in a longitudinally central portion is ASK-C70°. The metal core 2*a* has a tapered shape so that a pressure in a fixing nip provided by the fixing belt 1 and the pressing roller 2 is uniform over the length even when a pressure applying member 3 which will be described hereinafter is flexed in a pressed state.

The fixing nip N between the fixing belt 1 and the pressing roller 2 in this embodiment has a width (rotational moving direction) is approx. 9 mm in the opposite longitudinal end portions and approx. 8.5 mm in the central portion when the fixing nip pressure is 600 N. With such selections, the recording material P feeding speed is higher in the opposite end portions than the central portion, and therefore, production of paper crease can be constrained.

Inside the fixing belt 1 the pressure applying member 3 is extended to apply an urging force between the fixing belt 1 and the pressing roller 2 to form the fixing nip N. The pressure applying member 3 is held by a stay 4 of metal extending in the longitudinal direction. In the induction heating device 70 side of the stay 4, there is provided an magnetism blocking core 5 as a magnetism blocking member for preventing a temperature rise by the induction heating.

Figure 4:
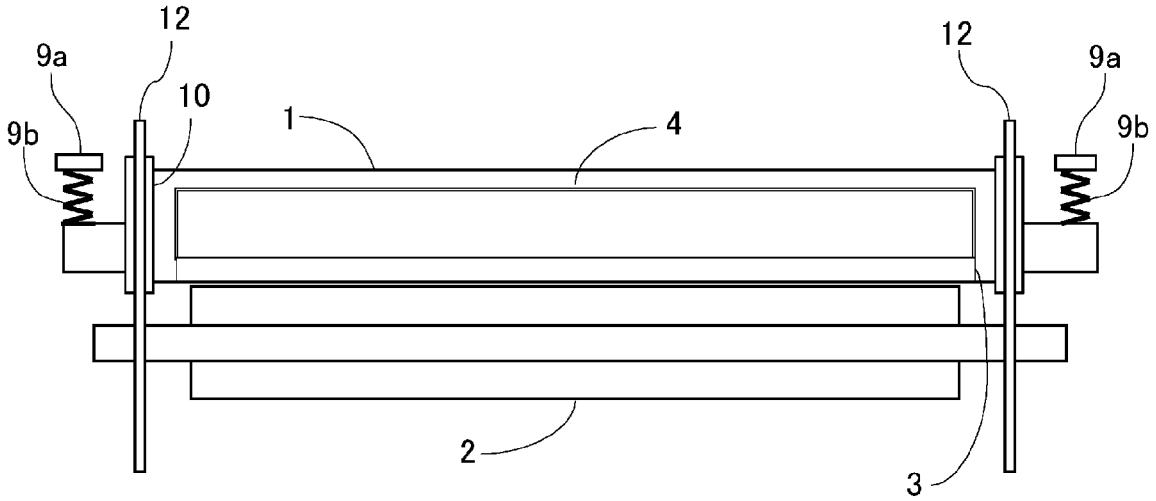
FIG. 4 is a schematic longitudinal sectional view of the fixing device.

The stay 4 is supported by a fixing flange 10 shown in FIG. 4 at the opposite longitudinal end portions. The fixing flange 10 is provided at each of the opposite longitudinal end portions of the fixing belt 1, as a regulating member for regulating the movement in the longitudinal direction of the fixing belt 1 and the configuration of the fixing belt 1 in the circumferential direction. Designated by 12 is a support side plate for supporting the fixing belt 1, and the fixing flange 10 is supported by the support side plate 12. The position of the fixing belt 1 is limited in the longitudinal direction by the support side plates 12 with fixing flanges 10 interposed therebetween. The fixing belt 1 includes by metal base layer. Therefore, the provision of the fixing flanges 10 abutted by the edges of the fixing belt 1 is enough to limit the widthwise offset of the fixing belt 1 even during the rotation.

A stay urging spring 9*b* is provided compressed between the end portion of the stay 4 penetrating the fixing flange 10 and a spring receiving member 9*a* of a device chassis, at each of the opposite ends, by which the stay 4 receives the force toward the pressing roller 2. By this, the pressure applying member 3 is press-contacted to the outer peripheral surface of pressing roller 2 sandwiching the fixing belt 1 to form the fixing nip N of a predetermined nip width.

The pressure applying member 3 is made of a heat resistive resin material, and the stay 4 is made of steel in this embodiment since a rigid is required to apply the pressure to the nip. The pressure applying member 3 is close to the excitation coil 38 which will be described hereinafter, particularly at the opposite end portions, and the magnetism blocking core 5 is extended over the length of the pressure applying member 3 above a top surface of the pressure applying member 3 to block a magnetic field generated by the excitation coil 38, thus preventing the heat generation in the pressure applying member 3.

Induction Heating Device

The induction heating device 70 heats the fixing belt 1 by electromagnetic induction (IH) (heating source, induction heating means). As shown in FIG. 2, the induction heating device 70 includes the excitation coil 38 and groups 37A, 37B of external magnetic cores. The excitation coil 38 is made of Litz wire, for example, and is wound into an elongated ship-bottom shape to oppose a peripheral surface and a part of the side surfaces. External magnetic core groups 37A, 37B are arranged in the widthwise direction to cover the excitation coil 38 so as to substantially prevent leakage of the magnetic field generated by the excitation coil 38 toward other than the metal layer (electro conductive layer of the fixing belt 1), that is, other than the heating member (in order to suppress such leakage). In other words, the external magnetic core groups 37A, 37B efficiently directs the AC magnetic flux generated from the excitation coil 38 to the induction heat generation member, that is, the fixing belt 1. That is, it is provided for raising the efficiency of the magnetic circuit (magnetic path) and for magnetism blocking. The material of the external magnetic core groups 37A, 37B is preferably ferrite or the like which has a low high magnetic permeability remanent magnetic flux density.

Figure 5:
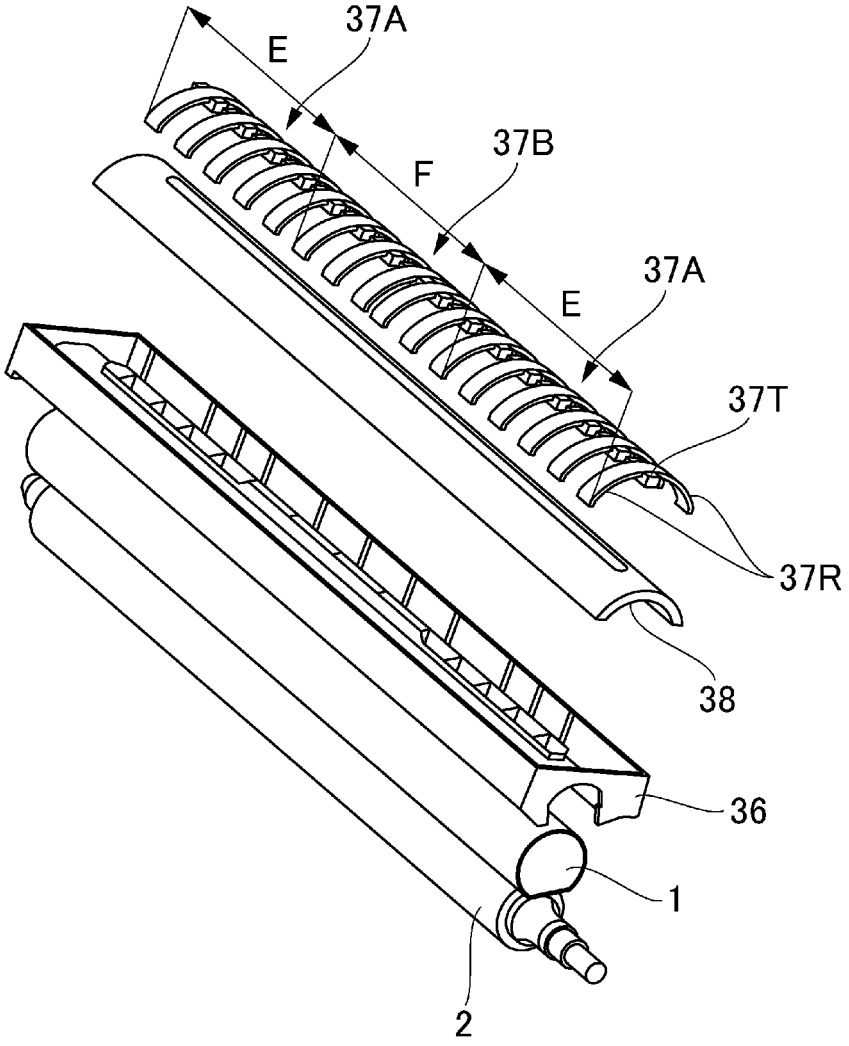
FIG. 5 is an exploded perspective view of a part of the fixing device.

{0036} external magnetic core groups 37A, 37B include a plurality of core elements 37T, 37R. As shown in FIG. 5, the core elements 37T, 37R are arranged along the longitudinal direction of fixing belt 1 (widthwise direction of the fed recording material). The core elements 37T, 37R may have an integral structure in each group 37A, 37B. Such excitation coil 38 and external magnetic core groups 37A, 37B are supported by an electrically insulative resin material of the frame 36 as a coil holder. The magnetic flux generated by the excitation coil 38 is directed to the fixing belt 1 by the external magnetic core groups 37A, 37B so that the base layer 1*a* of a fixing belt 1 generates heat by the magnetic flux therethrough.

Such an induction heating device 70 faces the top outer peripheral surface of the fixing belt 1 with a predetermined gap therebetween. That is, the induction heating device 70 is disposed close to the outer peripheral surface of fixing belt 1. The gap between the outer peripheral surface of the fixing belt 1 and the induction heating device 70 is degree 2 mm, for example.

The structure of the induction heating device 70 will be described in detail. In this embodiment, the fixing belt 1 and the excitation coil 38 of the induction heating device 70 are electrically insulated by a mold having a thickness of approx. 2 mm. The clearance between the fixing belt 1 and the excitation coil 38 is constant over the length so that the fixing belt 1 is uniformly heated.

The excitation coil 38 is supplied with the high frequency current of 20-50 kHz through lines 58 which will be described hereinafter, and the induction heat generation occurs in the base layer 1*a* of the fixing belt 1. The frequency of the high frequency current is changed to control the electric power inputted to the excitation coil 38 on the basis of a detected value of the temperature sensor TH1 so as to maintain a target temperature of the fixing belt 1, that is, 180 degree C.

In rotation state of the fixing belt 1, the excitation coil 38 of the induction heating device 70 is supplied with the high frequency current of 20-50 kHz from the voltage source device (excitation circuit) 101. By the magnetic field generated by the excitation coil 38, the induction heat generation is caused in the metal layer (electroconductive layer) of the fixing belt 1. The temperature sensor TH1 as the temperature detecting means is a temperature detecting element such as a thermister, for example, and is contacted to the widthwise center portion (central portion with respect to generatrix direction) of the inner surface portion of the fixing belt 1. More specifically, the temperature sensor TH1 is mounted to the pressure applying member 3 through an elastic supporting member, so that the contact state can be maintained even if the contact surface of the fixing belt 1 waves.

The temperature sensor TH1 detects the temperature of the portion of the fixing belt 1 in the recording material passing region, and the detected temperature information is fed-back to the control circuit portion 102 as the controlling means. The control circuit portion 102 controls the electric power inputted the excitation coil 38 from the voltage source device 101 so that is detected temperature inputted from the temperature sensor TH1 is maintained at the predetermined target temperature (fixing temperature). That is, the detected temperature of the fixing belt reaches a predetermined temperature, the electric power supply to the excitation coil 38 is shut off. In this embodiment, the frequency of the high frequency current is changed to control the electric power inputted to the excitation coil 38 on the basis of the detected value of temperature sensor TH1 such that the temperature of the fixing belt 1 is constantly maintained at the target temperature 180 degree C.

In this embodiment, the induction heating device 70 including the excitation coil 38 is disposed outside the fixing belt 1 which becomes high temperature, not inside thereof. Therefore, the temperature of the excitation coil 38 can be maintained relatively low, and therefore, the electric resistance can be maintained relatively low, and the loss of the joule heat generation can be reduced even if the high frequency current is supplied. In addition, by the excitation coil 38 being disposed outside, the diameter of the fixing belt 1 and therefore the thermal capacity thereof can be reduced, and the energy consumption can be saved. The warming-up time of the fixing device A of this embodiment is approx. 15 sec up to the target temperature 180 degree C. when 1200 W, for example is inputted to the excitation coil 38, since the thermal capacity is significantly low. Therefore, the heating operation during the stand-by time, is unnecessary, and the electric power consumption amount is very low.

The fixing belt 1 is rotated by the pressing roller 2 being rotated by the motor (driving means) M1 controlled by the control circuit portion 102, at least during the image formation execution. It is rotated at substantially the same peripheral speed as the feeding speed of recording material P carrying the unfixed toner image T fed from the secondary transfer portion T2 (upstream with respect to the recording material feeding direction) shown in FIG. 1. In this embodiment, the speed of the surface of the fixing belt 1 is 200 mm/sec, with which full-color images can be fixed on 50 A4 size sheets, or on 32 A4R size sheets per minute.

As shown in FIG. 2, the recording material P with the unfixed toner image T thereon is introduced into the fixing nip N along the guiding member (unshown) with the toner image carrying side facing toward the fixing belt 1. It is close-contacted to the outer peripheral surface of fixing belt 1 in the fixing nip N and is nipped and fed together with the fixing belt 1. By this, mainly the heat of the fixing belt 1 is applied to it, and the pressure of the fixing nip N is applied to it, so that the unfixed toner image T is fixed on the surface of the recording material P. The recording material P having passed through the fixing nip N is self-separated from the outer peripheral surface of the fixing belt 1 by the curvature of the surface of the fixing belt 1 at the outlet portion of fixing nip N, and then is discharged to the outer of the fixing device.

Of the outside magnetic cores 37A, 37B, the external magnetic core groups (movable core groups) 37A provided at the opposite sides (region E in FIG. 5) of the fixing belt 1 are movable toward and away from the excitation coil 38 and the fixing belt 1. In the non-passing portion of the fixing nip N, the gap between the fixing belt 1 and the external magnetic core 37 is expanded to decrease the magnetic flux density passing the fixing belt 1, thus decreasing the amount of heat generation of the fixing belt 1. On the other hand, the external magnetic core group (fixed core group) 37B in the widthwisely middle portion (region F in FIG. 5) of fixing belt 1 is fixed to the frame 36.

Movement of Movable Core (External Magnetic Core 37A)

Figure 6:
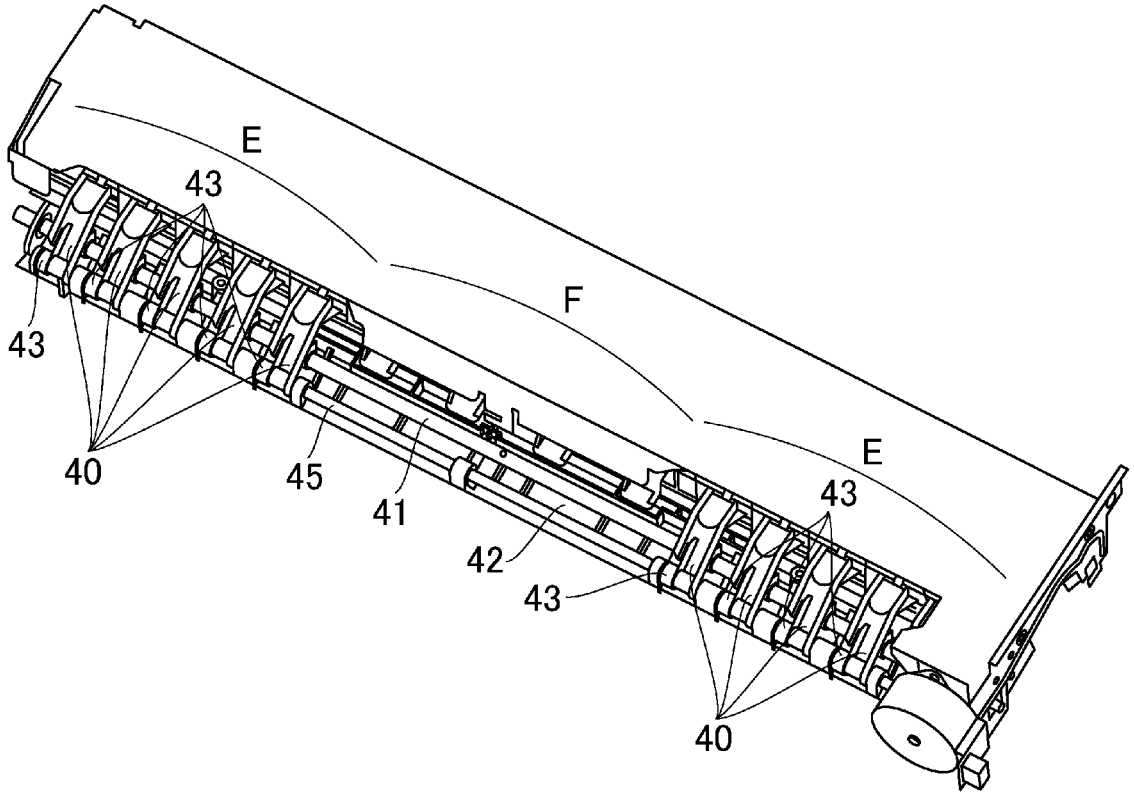
FIG. 6 is a perspective view of an induction heating device.
Figure 7:
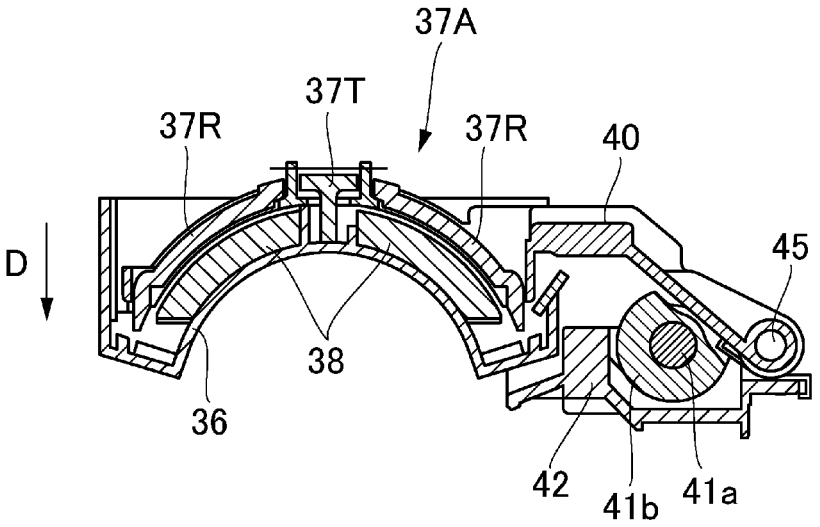
FIGS. 7(*a*) and 7(*b*) are sectional views of the induction heating device illustrating a movement state of a movable core.
Figure 7:
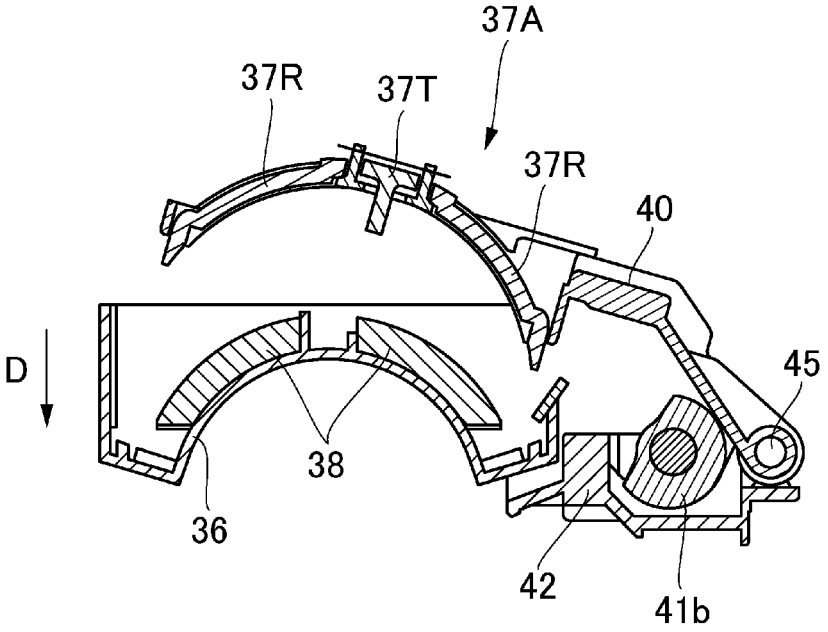

Referring to FIGS. 6, 7(*a*), and 7(*b*), a moving mechanism (retracting mechanism) for the external magnetic core groups (movable core groups) 37A will be described. As shown in FIG. 6, the external magnetic core groups 37A are held by a housing member 40. The housing member 40 is supported by a shaft 45 extending in the widthwise direction, and is rotatably held at the opposite end portions of a mounting member 42 mounted to the frame (coil holder) 36 holding the excitation coil 38. The mounting member 42 may be integral with the frame 36. The housing member 40 is urged in the direction of an arrow D in FIGS. 7(*a*) and 7(*b*) by a twisted coil spring 43 provided co-axially with the shaft 45. The housing member 40 holding the outside magnetic core groups 37A is contacted to the frame 36 holding the excitation coil 38 at a first position shown in FIG. 7(*a*), by a spring force a coil spring 43. By this, the relative positions of the external magnetic core groups 37A relative to the excitation coil 38 are made uniform over the width. Thus, a temperature distribution uniform over the width can be provided.

The external magnetic core groups 37A are moved (retracted) to a second position shown in FIG. 7(*b*) by the moving mechanism in accordance with the size of the recording material. In order to move the groups 37A, there is provided a cam 41*b* for contacting to housing member 40 to rotate the housing member 40, as shown in FIG. 7(*b*). The cam 41*b* is fixed to a cam shaft 41*a* extended in the widthwise direction. In order to move the external magnetic core groups 37A to the second position, the cam shaft 41*a* is rotated by a driving means (unshown). Then, the cam 41*b* provided on the cam shaft 41*a* lifts the housing member 40 holding the groups 37A push-up and the housing member 40 rotates about the shaft 45 to move the groups 37A to the second position shown in FIG. 7(*b*). Another moving type is usable if the distance between the excitation coil 38 and the groups 37A are made enough.

Countermeasurement Against the Temperature Rise in Non-Passing Portion

As shown in FIG. 5, external magnetic core groups 37A and 37B are arranged in the widthwise direction of the fixing belt 1, and include the portion corresponding to the winding center portion of the excitation coil 38 and a portion surrounding the excitation coil 38. The groups 37A in the region E are movable by the above-described moving mechanism. The group 37B in the region F is not retracted by the moving mechanism but is fixed on the frame 36 so as to be stationary relative to the excitation coil 38. The region F is determined corresponding to the width of a small size recording material having a small width, and the region F plus the regions E covers the width of a large size recording material having a large width.

Figure 8:
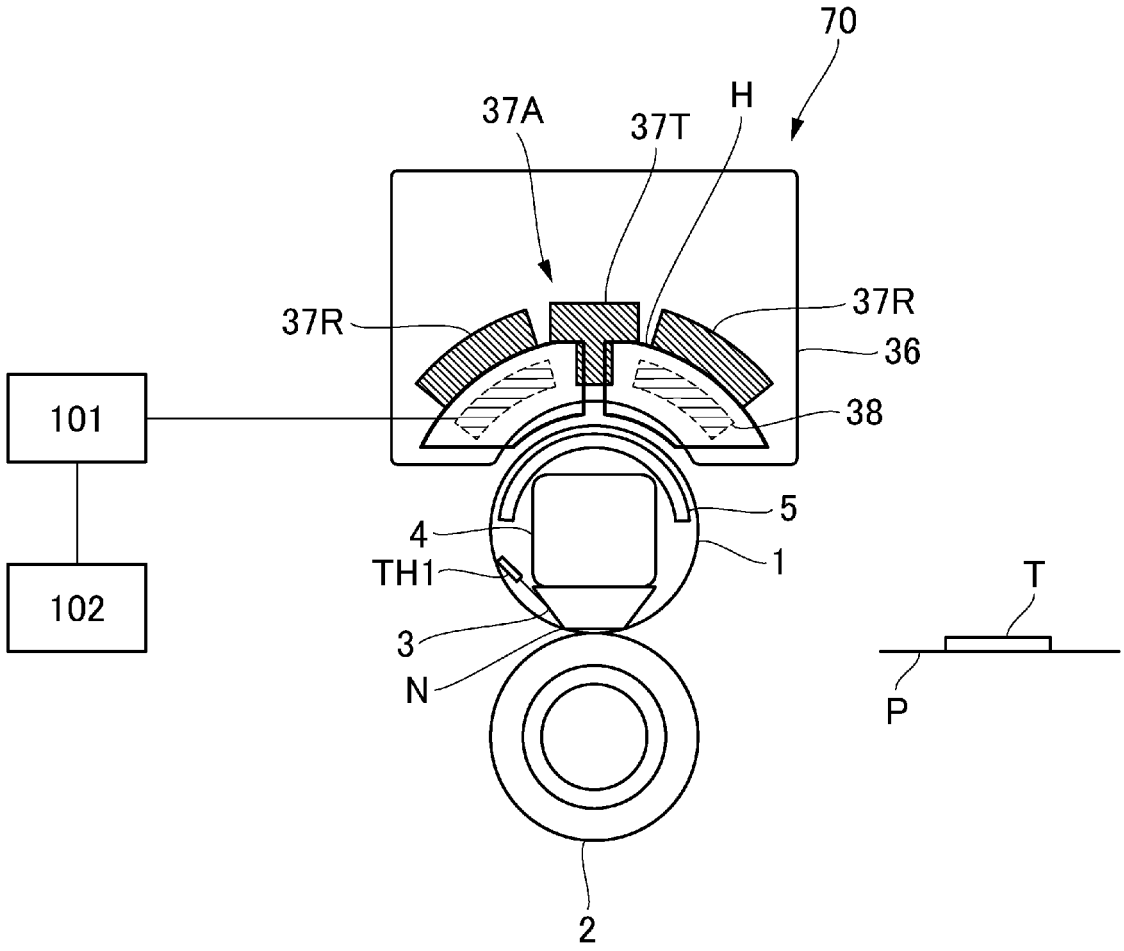
FIG. 8 is a schematic cross-sectional view of the fixing device in which the movable core is close to a coil.

When such a large size recording material is introduced to the nip, the external magnetic core groups 37A in the left and right regions E of FIG. 5 are placed in the first position as shown in FIG. 8. The pressing roller 2 of the fixing device A is driven in this state, and the excitation coil 38 is supplied with the electric power to effect the fixing operation. In FIG. 8, magnetic circuits by the external magnetic core groups 37A and the fixing belt 1 around the excitation coil 38 in this state are indicated by lines H.

Figure 9:
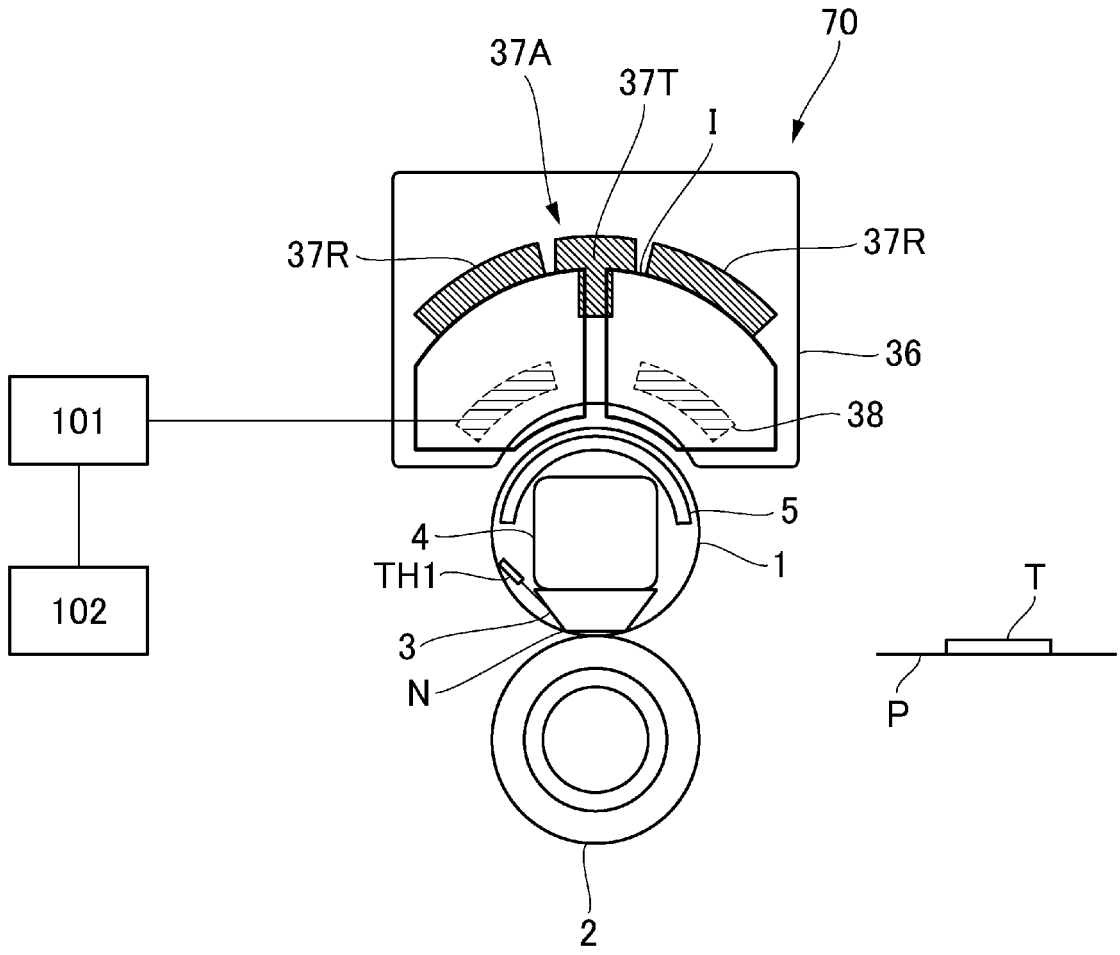
FIG. 9 is a schematic cross-sectional view of the fixing device in which the movable core is away from the coil.

On the other hand, when a small size recording material is introduced to the nip, the left and right external magnetic core groups 37A at the regions E as shown in FIG. 9 are moved (retracted) to the second position to expand the gap between the external magnetic core groups 37A and the excitation coil 38. In FIG. 9, magnetic circuits by the external magnetic core groups 37A and the fixing belt 1 around the excitation coil 38 in this state are indicated by lines I. In such a state, the efficiency of magnetic circuit is low so that the amount of heat generation of fixing belt 1 lowers.

Figure 10:
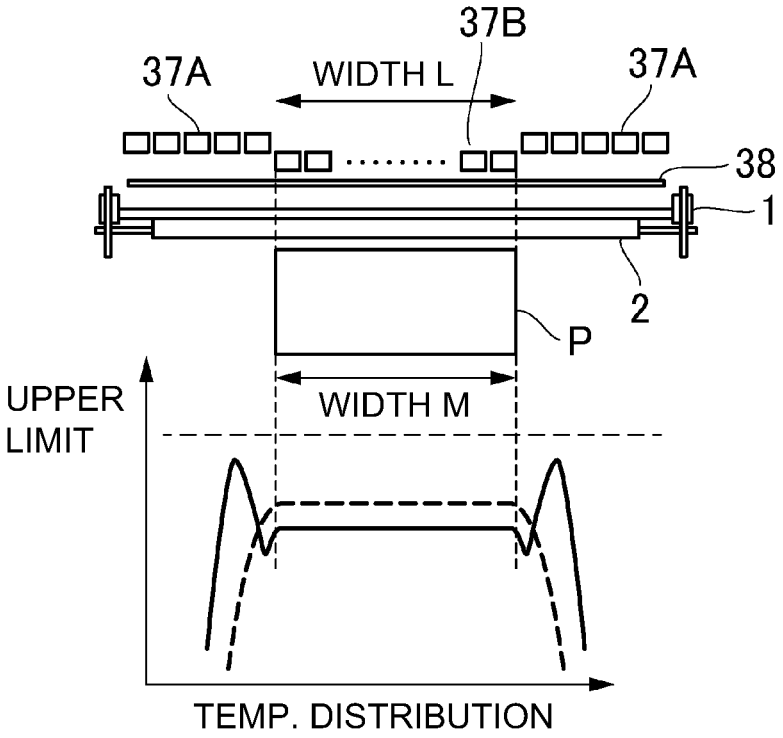
FIG. 10 is a schematic view of the fixing device in a state that the movable core is moved corresponding to the width of the recording material, and a temperature distribution of the fixing belt.

As a result, the temperature distribution of the fixing belt 1 in the widthwise direction is as shown in FIG. 10. FIG. 10 shows temperature distributions of the fixing belt in the widthwise direction in the first sheet (broken line) and the 500th sheet (solid line) in the case of continuous fixing processing when the width M of recording material P is the same as the width L in which the magnetic flux by the external magnetic core groups 37A, 37B is strong. As will be understood, the temperature distribution in the first sheet covers the width M of recording material P to assure the fixing property for the recording material P. In the temperature distribution in the 500th sheet, the temperature of the fixing belt is maintained not more than the upper limit temperature even in the non-passing portion regions outside the width M of recording material P, so that the durability of the fixing belt 1 is not deteriorated. Thus, the fixing property for the recording material P and the durable of the fixing belt 1 can be both assured by increasing the gap between the excitation coil 38 and the external magnetic core groups 37A in the recording material non-passing portion.

In the above-described example, the external magnetic core groups 37A are moved as a whole when the sheet width is small. However, only a part of the external magnetic cores may be moved in accordance with the width of the sheets.

Coil Pushing Portion

In the above-described IH fixing in which the fixing is carried out using the induction heating device 70, the distances between the excitation coil 38 and the external magnetic core groups 37A and 37B and the distance between the excitation coil 38 and the fixing belt 1 are important from the standpoint of assuring the fixing efficiency. Maintaining the constant distances over the width is important from the standpoint of stabilization of the temperature distribution of the fixing belt 1 in the widthwise direction. On the other hand, in the case that the external magnetic core group 37A are of movable type as in this example, there is a likelihood that a part of excitation coil 38 lifts from the frame (coil holder) 36. If this occurs, the distances between the excitation coil 38 and the fixing belt 1 may change with the result of interference between the external magnetic core groups 37A and the excitation coil 38 and positional deviations.

The excitation coil 38 is preferably as close as possible to the fixing belt 1. In addition, the distances between the excitation coil 38 and the external magnetic core groups 37A, 37B is as small as possible.

For this reason, in this embodiment, the excitation coil 38 is fixed to the frame (coil holder) 36 in the manner described below. A description will be provided referring to FIG. 11 to FIG. 15. In this embodiment, a part of the frame 36 is in a side opposite from the external magnetic core group 37A functioning movable core with the excitation coil 38 interposed therebetween, and the excitation coil 38 is provided on the frame 36. That is, the excitation coil 38 is provided on a curved portion 36*a* (FIGS. 13 and 14) which is curved along the outer peripheral surface of the fixing belt 1 in the portion of the frame 36 close to the outer peripheral surface of the fixing belt 1. The entire area of an excitation coil 38 is bonded to the curved portion 36*a* of the frame 36 by a double coated tape or the like.

Figure 11:
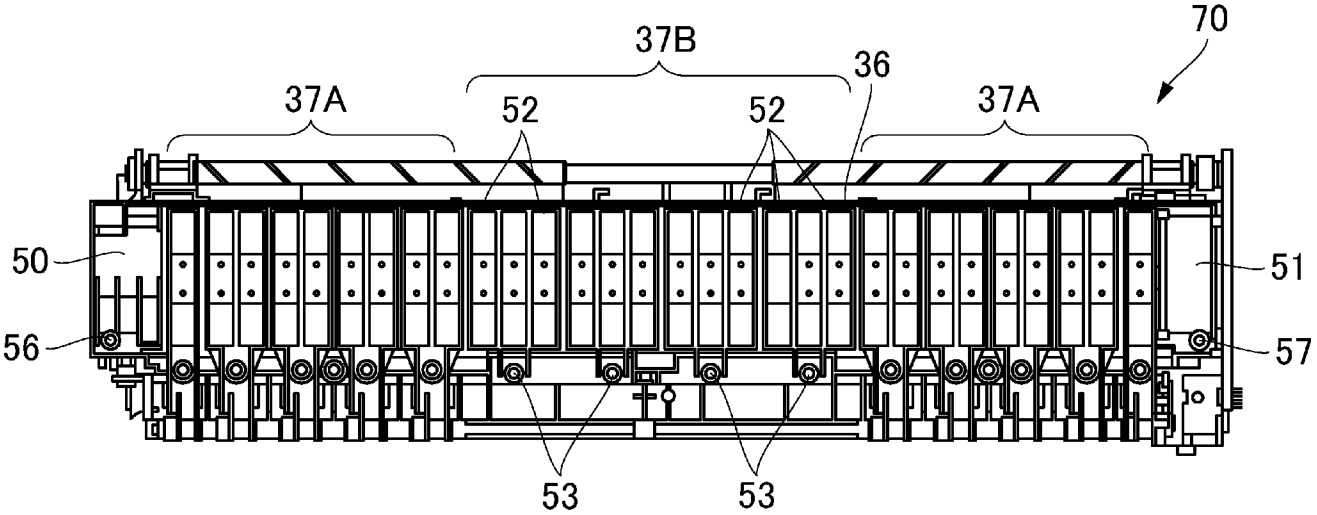
FIG. 11 is a top plan view of the induction heating device in which the movable core, a fixed core and a coil pushing portion are exposed.
Figure 12:
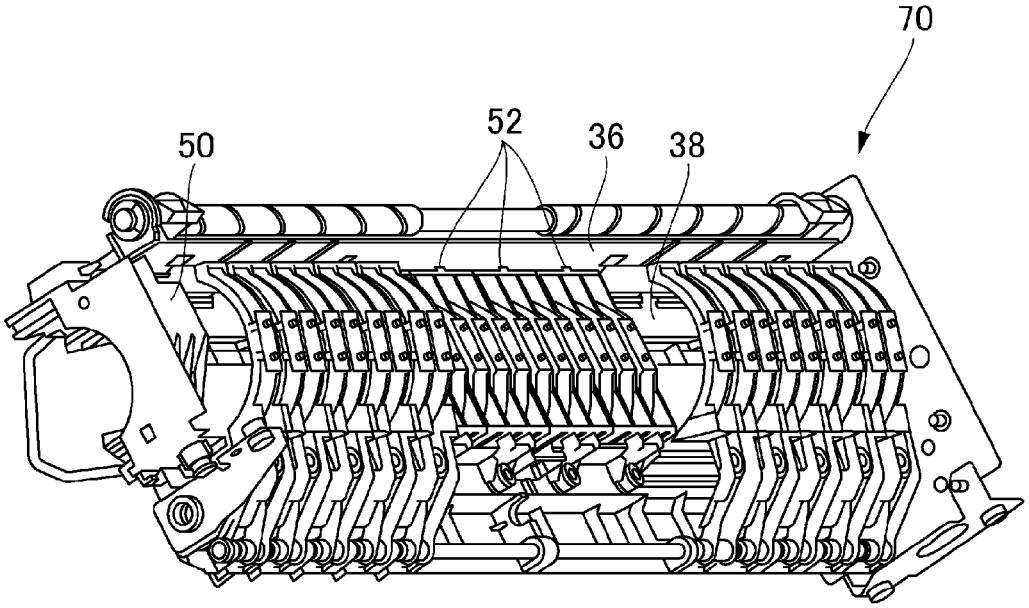
FIG. 12 is a perspective view.

As shown in FIGS. 11 and 12, the widthwise middle portion of the excitation coil 38 is press-contacted to the frame 36 by the external magnetic core group (fixed core group) 37B fixed to the frame 36. In addition, the coil pushing portions (press-contact members) 50 and 51 presses, against the frame 36, both widthwise end portions of the excitation coil 38 outside the portion covered by the external magnetic core groups (movable core groups) 37A.

Figure 13:
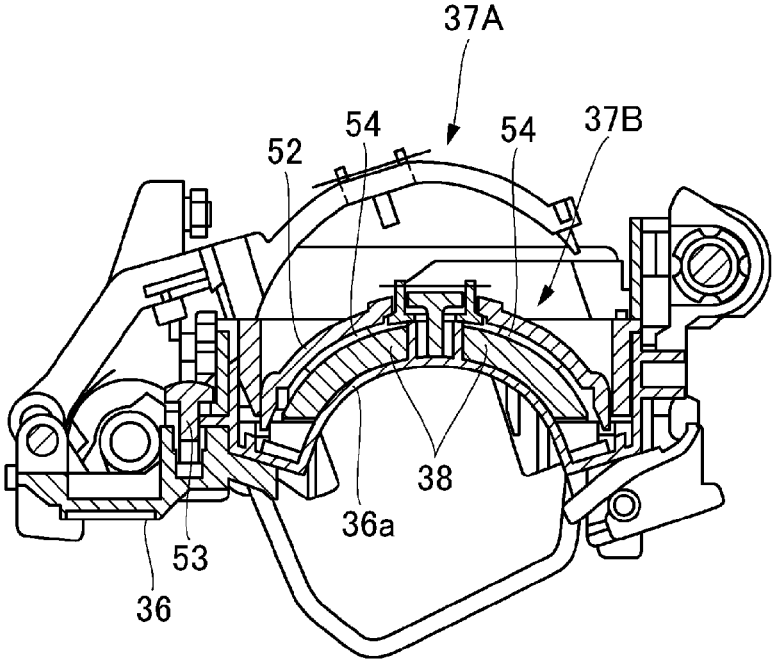
FIG. 13 is a sectional view of the induction heating device taken along a line through the fixed core.

More particularly, as shown in FIG. 13, the external magnetic core group (fixed core group) 37B is held by the housing member (core holder) 52, similarly to the external magnetic core groups 37A. The housing member 52 is provided with a projection 54 on the excitation coil 38 side. The housing member 52 is fixed to the frame 36 by screws 53 while pressing the excitation coil 38 toward the curved portion 36*a* of the frame 36 by the projections 54, so that the widthwise middle portion of the excitation coil 38 is pressed against the curved portion 36*a* of the frame 36.

Figure 14:
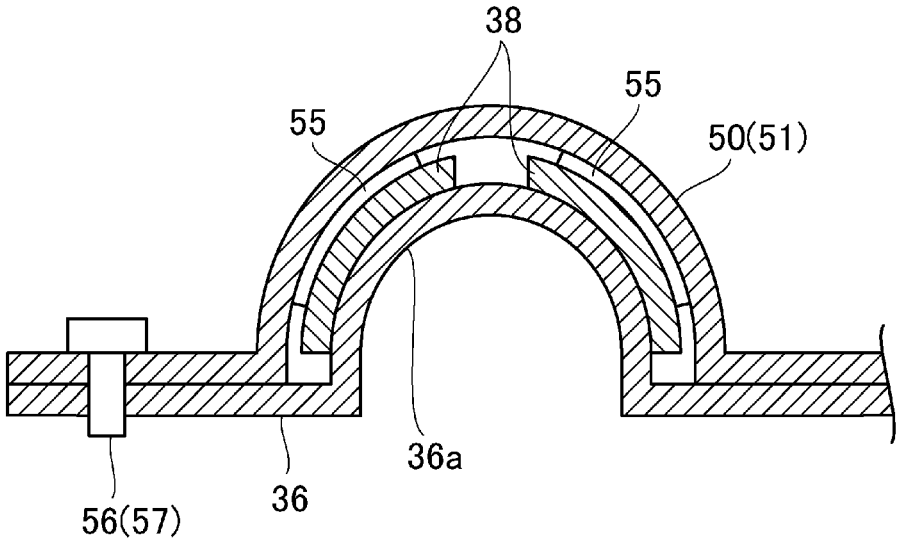
FIG. 14 is a schematic view of the induction heating device taken along a line through the coil pushing portion.

In addition, as shown in FIG. 11, coil pushing portions 50, 51 are provided at the widthwise end portions of the external magnetic core groups (movable core groups) 37A, respectively. As shown in FIG. 14, the coil pushing portions 50 and 51 are provided with projections 55 on the excitation coil 38 side, similarly to the housing member 52. The coil pushing portions 50, 51 are fixed to the frame 36 by screws 56, 57 while pressing the excitation coil 38 toward the curved portion 36*a* of frame 36 by the projections 55, so that the opposite widthwise end portions of the excitation coil 38 are pressed against the curved portion 36*a* of the frame 36, respectively.

The coil pushing portions 50, 51 do not hold the core. In addition, the coil pushing portions 50, 51 are made of non-magnetic metal and may be made of a material is capable of blocking the magnetic flux generated by excitation coil 38. In this case, it is preferable that the entire areas of opposite end portions of the excitation coil 38 exposed at the widthwise end portions of the external magnetic core groups (movable core groups) 37A are covered.

Figure 15:
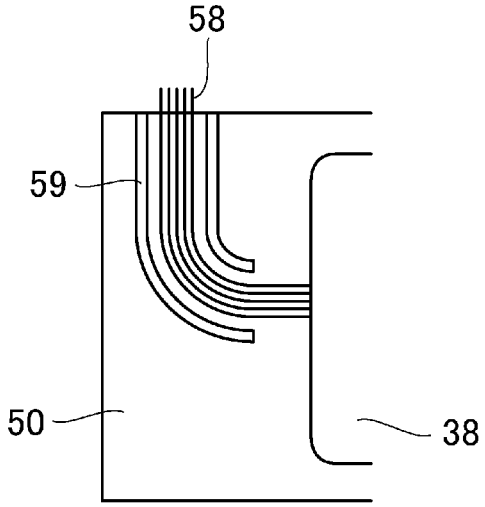
FIG. 15 is a schematic view illustrating a guide portion for the coil pushing portion.

In addition, as shown in FIG. 15, one (50) of the coil pushing portions 50 and 51 is provided with a guide portion 59 for guiding bundle of wires 58 for electric power supply to the excitation coil 38 toward an outside of the frame 36. In other words, the coil pushing portion 50 functions also as a guide for the bundle of wires 58 for the excitation coil 38 toward the frame 36.

In this embodiment, as described above, the opposite widthwise end portions of the excitation coil 38 are pressed against the frame 36 by the coil pushing portions 50, 51, and therefore, the excitation coil 38 is prevented from lifting even in the structure in which the magnetic core covering the excitation coil 38 is a movable type. The excitation coil 38 may be fixed to the frame (coil holder) 36 by a simple and easy method using a double coated tape or the like, for example. However, the frame the coil holder) 36 is made of mold resin material, and therefore, a part of the excitation coil 38 may be peeled off due to thermal expansion and/or thermal contraction by abrupt temperature rise by the induction heating. Furthermore, a force may be applied externally to the excitation coil 38 through the bundle 58 of wires, and the excitation coil 38 may be lifted by such a force.

Under the circumstances, in this embodiment, in addition to the simple bonding of the excitation coil 38 to the frame 36, the opposite widthwise end portions of the excitation coil 38 are pressed against the frame 36 by the coil pushing portions 50, 51. By this, the lifting of the excitation coil 38 can be suppressed even if the frame 36 is thermally expanded and contracted or even if the force is applied externally to the excitation coil 38.

In addition, in this embodiment, the widthwise middle portion of the excitation coil 38 is pressed against the frame 36 by the external magnetic core group 37B which is the fixed core group, and therefore, the lifting of the excitation coil 38 can be suppressed assuredly. By the suppression of the lifting of the excitation coil 38, the position of the excitation coil 38 can be stabilized. As a result, the distance between the excitation coil 38 and the external magnetic core groups 37A, 37B and the distance between the excitation coil 38 and the fixing belt 1 are stabilized, so that the temperature distribution of the fixing belt 1 in the widthwise direction is maintained uniform, and therefore, an image defect or the like image glossiness non-uniformity can be suppressed.

Furthermore, in this embodiment, in the space between the housing member 40 and the excitation coil 38 in the range of the movable core groups 37A, there is no member corresponding to the coil pushing member, so that the external magnetic core groups (movable core groups) 37A in the first position shown in FIG. 7(*a*). Therefore, the clearance between the movable core 37A and the excitation coil 38 in the first position can be made same as the clearance between the external magnetic core group (fixed core group) 37B and the excitation coil 38. As a result, the relative position of each of the external magnetic core groups 37A and 37B relative to the excitation coil 38 is uniform over the width.

In this embodiment, the coil pushing portion 50 also functions as a guide for the bundle of wires 58, and therefore, the guiding function for the bundle 58 and the fixing of the excitation coil 38 can be accomplished without increasing the number of parts.

The bonding of the excitation coil 38 to the frame (coil holder) 36 may be omitted. It is preferable that a cross-sectional configuration of the excitation coil 38 before the excitation coil 38 is set in the frame 36 is smaller than that radius of curved portion 36*a* of frame 36 formed along the curved of the outer peripheral surface of the fixing belt 1. By this, in the state that the excitation coil 38 is set relative to the curved portion 36*a* of the frame 36, the excitation coil 38 elastically expands, and therefore, the excitation coil 38 can be fixed to the frame 36 by the elastic restoring force.

In the foregoing description, the widthwise middle portion of the excitation coil 38 is fixed by the external magnetic core 37B as the fixed core, but the present invention is applicable also for the structure in which the widthwise middle portion of the excitation coil 38 is not fixed. For example, the external magnetic cores may all be the movable cores. Even in this case, the lifting of the excitation coil can be suppressed if the opposite widthwise end portions of excitation coil are fixed.

In the foregoing, the fixing device is taken as an example of the image heating apparatus, but the present invention is applicable to other structures. For example, it is applicable to an apparatus for adjusting the glossiness of the image by reheating and repressing the already fixed image.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 195678/2012 filed Sep. 6, 2012, which is hereby incorporated by reference.

What is claimed is:

1. An image heating apparatus comprising:

a rotatable heating member configured and positioned to heat a toner image on a sheet;

an excitation coil provided outside of said rotatable heating member and configured and positioned to cause electromagnetic induction heat generation in said rotatable heating member;

a magnetic core provided opposed to said rotatable heating member with said excitation coil between said magnetic core and said rotatable heating member and configured and positioned to direct a magnetic flux produced by said excitation coil to said rotatable heating member;

a retracting mechanism configured to retract said magnetic core from said excitation coil;

a coil holder configured and positioned to hold a side of said excitation coil adjacent to said rotatable heating member; and first and second pressing members configured and positioned to press said excitation coil against said coil holder in outside portions beyond said magnetic core in a longitudinal direction of said rotatable heating member, respectively.

2. An apparatus according to claim 1, further comprising a fixed magnetic core provided opposed to said rotatable heating member with said excitation coil therebetween and fixed so that a relative position thereof relative to said excitation coil does not change, wherein said fixed magnetic core presses said excitation coil against said coil holder.

3. An apparatus according to claim 2, wherein said fixed magnetic core is disposed in a longitudinally middle portion of said rotatable heating member, and said magnetic core retractable by said retracting mechanism is disposed between said fixed magnetic core and said first pressing member.

4. An apparatus according to claim 2, further comprising a core holder configured and positioned to hold said fixed magnetic core, wherein said fixed magnetic core presses said excitation coil against said coil holder with said core holder.

5. An apparatus according to claim 1, wherein said first pressing member is provided with a guide portion configured and positioned to guide a bundle of wires connected to said excitation coil outwardly of said coil holder.

6. An apparatus according to claim 1, wherein said retracting mechanism controls a retracting operation of said magnetic core in accordance with a width of the sheet.

7. An apparatus according to claim 1, wherein said magnetic core has a portion disposed at a winding central portion of said excitation coil.

8. An image heating apparatus comprising:

a rotatable heating member configured and positioned to heat a toner image on a sheet;

an excitation coil provided outside of said rotatable heating member and configured and positioned to cause electromagnetic induction heat generation in said rotatable heating member;

a plurality of magnetic cores arranged opposed to said rotatable heating member with said excitation coil between said magnetic cores and said rotatable heating member along a longitudinal direction of said rotatable heating member and configured and positioned to direct a magnetic flux generated by said excitation coil to said rotatable heating member, said magnetic cores including a first core group of magnetic cores in a central region of said rotatable heating member in the longitudinal direction, and second and third core groups of magnetic cores in outside portions outwardly beyond said first core group in the longitudinal direction, respectively;

a retracting mechanism configured and positioned to retract at least one core of said second core group and at least one core of said third core group from said excitation coil;

a coil holder configured and positioned to hold a side of said excitation coil adjacent to said rotatable heating member; and first and second pressing members configured and positioned to press said excitation coil against said coil holder in outside portions outwardly beyond said second and third core groups in the longitudinal direction, respectively, wherein said first core group is fixed so as to press said excitation coil against said coil holder.

9. An apparatus according to claim 8, further comprising a core holder configured and positioned to hold said first core group, and said first core group presses said excitation coil against said coil holder with said core holder.

10. An apparatus according to claim 8, wherein said first pressing member is provided with a guide portion configured and positioned to guide a bundle of wires connected to said excitation coil outwardly of said coil holder.

11. An apparatus according to claim 8, wherein said retracting mechanism controls retracting operations of said second and third core groups in accordance with a width of the sheet.

12. An apparatus according to claim 11, wherein said retracting mechanism retracts a part of said second magnetic core group and a part of said third magnetic core group when a width of the sheet is a predetermined width.

13. An apparatus according to claim 8, wherein said magnetic cores have portions disposed at a winding central portion of said excitation coil, respectively.

* * * * *